US008770501B2

(12) United States Patent
Laukka et al.

(10) Patent No.: US 8,770,501 B2
(45) Date of Patent: Jul. 8, 2014

(54) METHOD AND EQUIPMENT FOR CONTROLLING CRUSHING PROCESS

(75) Inventors: Juha Laukka, Siivikkala (FI); Kari Kokkonen, Tampere (FI); Janne Leinonen, Noormarkku (FI)

(73) Assignee: Metso Minerals, Inc., Helsinki (FI)

( * ) Notice: Subject to any disclaimer, the term of this patent is extended or adjusted under 35 U.S.C. 154(b) by 564 days.

(21) Appl. No.: 12/737,201

(22) PCT Filed: Jun. 23, 2009

(86) PCT No.: PCT/FI2009/050556

§ 371 (c)(1),
(2), (4) Date: Dec. 17, 2010

(87) PCT Pub. No.: WO2009/156585

PCT Pub. Date: Dec. 30, 2009

(65) Prior Publication Data

US 2011/0089270 A1 Apr. 21, 2011

(30) Foreign Application Priority Data

Jun. 27, 2008 (FI) ..... 20080416

(51) Int. Cl.
*B02C 25/00* (2006.01)

(52) U.S. Cl.
USPC ..... 241/29; 241/30; 241/34; 241/152.2

(58) Field of Classification Search
USPC ..... 241/30, 34, 35, 29
See application file for complete search history.

(56) References Cited

U.S. PATENT DOCUMENTS

| | | | | | |
|---|---|---|---|---|---|
| 3,480,212 | A | * | 11/1969 | Schubert et al. | 241/34 |
| 4,179,074 | A | | 12/1979 | Flavel | 241/24 |
| 4,267,981 | A | * | 5/1981 | Rowland, Jr. | 241/30 |
| 4,281,800 | A | | 8/1981 | Flavel | 241/24 |
| 4,909,449 | A | | 3/1990 | Etheridge | 241/34 |
| 6,467,707 | B1 | | 10/2002 | Williams, Jr. | 241/18 |
| 6,595,443 | B2 | * | 7/2003 | Ottergren | 241/29 |

FOREIGN PATENT DOCUMENTS

| | | | |
|---|---|---|---|
| DE | 197 27 348 | A1 | 1/1999 |
| EP | 0 811 427 | A2 | 12/1997 |
| JP | 54147564 | * | 11/1979 |
| JP | S55-13107 | A | 1/1980 |
| JP | H11-017627 | A | 2/1999 |
| JP | 2003211017 | A | 7/2003 |
| JP | 2004202383 | A | 7/2004 |

* cited by examiner

*Primary Examiner* — Mark Rosenbaum
(74) *Attorney, Agent, or Firm* — Harrington & Smith

(57) ABSTRACT

A method, a system and a crushing plant for controlling a crushing process, which crushing plant includes a feeder for feeding material to be crushed to a crusher, a first crusher for crushing the fed material, a second crusher for crushing the crushed material and a conveyor for conveying the crushed material from said first crusher to said second crusher. A crushing plant includes measurement means for measuring the volume flow of the crushed material and control means for controlling the feeding speed of the material to be crushed responsive to change in the volume flow of the crushed material.

16 Claims, 4 Drawing Sheets

METHOD AND EQUIPMENT FOR CONTROLLING CRUSHING PROCESS

FIELD OF THE INVENTION

The invention relates to controlling processing of mineral material and particularly, though not exclusively to the method and equipment for controlling crushing process.

BACKGROUND OF THE INVENTION

A crushing plant typically consists of a preliminary crusher, intermediate crusher and one or more after-crushers and screen decks. Depending on the number of after-crushers, the plant is called either two, three of four phase crushing plant. In four phase crushing plants, the second after-crusher may be replaced by an after-crusher for shaping of material.

Source material is fed with a wheel loader, a digger or a transfer vehicle to a feeder which measures out material to the feeder of the preliminary crusher. The product of the first crushing phase is transferred on a conveyor either directly to the intermediate or after-crusher or to the screen. In the second, third and fourth phase, crushing and screening is continued to prepare the desired end product.

The most common feeder type is a vibrating feeder that is used on a pre-determined basic speed. Usually, jaw crushers are used as preliminary crushers, usually gyratory crushers as intermediate crushers, gyratory and/or cone crushers are used as after-crushers. Screens are for example single-shaft free vibrating or multi-shaft directional impact screens.

At present, automation systems for crushing processes of mineral material are device-specific and not plant-specific or they are not at all available for mobile applications. To facilitate controlling the process, crusher-specific surface guards are used that work in an on-off fashion stopping/starting the feeding device (conveyor or feeder).

The present so-called on/off solutions do not optimise the productivity of the crushing process but the productivity of the plant depends to a great extent of actions made by an operator. The operator controls the speed of the feeder according to his ocular and empirical assessment. The operator also has to adjust the running parameters of the plant for each product and feed, separately manually case-specifically before starting the crushing process.

As the actions made by the operator directly influence the quantity and quality of the achieved end product, the operator's experience has a great impact in pursuing the desired crushing outcome. Inexperience in controlling the process weakens the crushing outcome regarding product capacity, desired particle distribution and quality.

The operator's concentrating in controlling the process is primarily important because even just a small slackening results in uncontrollability. For instance, when the feeder capacity exceeds the capacity of preliminary, intermediate or after-crushers it results in crushers flooding. For instance, when the feeder capacity is below the capacity of preliminary, intermediate or after-crushers it results in so-called idling of the crushers.

The operator's task is to create an even feed to the feeder so that the plant as a whole works at an optimal level. From the operator's point of view the control of the overall situation is further complicated by that material delivered to the feeder by a digger or a loading shovel often has to be collected from long distance in which case the feeder in the mean time becomes empty and functioning of the process weakens. Thus the operator does not have an easy task to keep the filling degree of the feeder at an optimal level.

SHORT SUMMARY OF THE INVENTION

At present, a process control system for a crushing plant has been invented with which the aforementioned disadvantages of prior art may be eliminated or at least mitigated.

The method in accordance with the invention enables at least partly replacing the adjusting actions made by the operator in controlling the crushing process.

The system is not to a great extent dependent on the actions in accordance with the use of the crushing operator because the operator's need of manual adjusting decreases. Thus the operator is left with more time for other tasks such as taking care that the process has enough material at all times. In addition to loading and/or setting the control parameters the operator's task remains to be to take care that there is a sufficient supply of processing material. The filling degree of the feeder has to be the highest possible for the processing system to work at an optimal level and to control the production of the plant optimally.

An automatic process control optimises the capacity of the crushing plant. Additionally, it effects in improving the quality of the end product and keeping the particle size distribution desired. Additionally, adjusting parameters found to be good may be used directly as default values for instance when the feed changes or the end product being made changes. The adjusting parameters of the process may be stored in advance in accordance to the feed being used and/or the end product being made and loaded quickly to be used if needed. User-specific differences in controlling the process may be minimised.

By getting the crushing process into an optimal level, without swaying regarding controlling the process, additionally a more even end product quality and smaller energy consumption are achieved.

To realise these purposes a method according to the invention is characterised by the characterising part of the independent claim 1.

A crushing plant according to the invention is characterised by the characterising part of the independent claim 6.

A system according to the invention is characterised by the characterising part of the independent claim 11.

A computer program product according to the invention is characterised by the characterising part of the independent claim 12.

The computer program product may be stored on a computer readable memory medium.

The invention is applicable to controlling a crushing process of crushing plants for various mineral materials. Such plants involve fixed plants, moveable plants and mobile such as track-mounted crushing plants.

DESCRIPTION OF THE DRAWINGS

The invention will be described in the following with greater detail with reference to the appended schematic drawings in which.

DETAILED DESCRIPTION OF THE INVENTION

Figure 1:
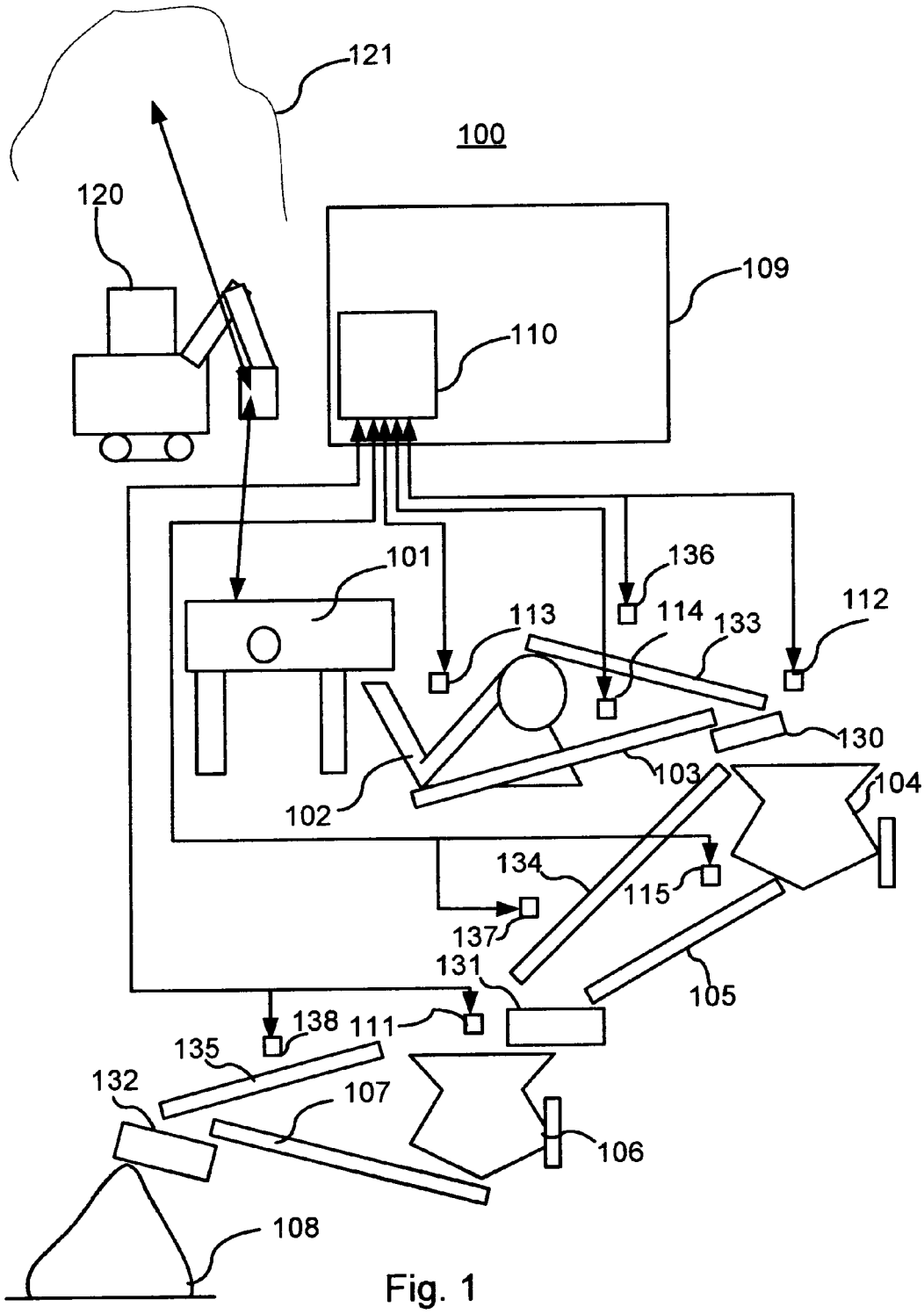
FIG. 1 presents a crushing plant

In FIG. 1, there is presented a crushing plant 100, which is preferably fixed by its implementation. Alternatively, a similar arrangement may be provided in several moveable parts of a crushing plant or in self-moving mobile crushing plants. A crushing plant consists of a feeder 101, preliminary crusher 102, first conveyor 103, intermediate crusher 104, second conveyor 105 and an after-crusher 106. Additionally, the crushing plant comprises a discharge conveyor 107 to discharge the end product for instance to a heap 108. Preferably, a crushing plant comprises a screen 130 with the help of which over-sized fraction is screened from the material crushed by the crusher 102 and which over-sized fraction is conveyed back to the crusher 102 along a conveyor 133. In the case of a single-deck screen, under-sized i.e. screened material is crushed in the crusher 104. In the case of a two-deck screen, over-sized fraction of the lower deck is guided to the crusher 104 and under-sized material is guided past the crusher 104 for example to the conveyor 105. Screens 131 and 132 and conveyors 134 and 135 attached to them, function in a corresponding way.

A crushing plant also comprises volume sensors (111 to 113 and sensors 114, 114, 136 to 138) with which the quantity of crushing material is measured as volume in crushers (102, 104 and 106) and conveyors (103, 105, 107, 133, 134, 135).

A crushing plant comprises one or more sensors located above the conveyors to measure the volume flow of material being conveyed. In a preferred embodiment of the invention, said sensor is located on the conveyor between the preliminary crusher 102 and the intermediate crusher 104 and/or on the conveyor 105 feeding the after-crusher 106. The sensor is preferably, for instance, an ultrasound sensor but other corresponding sensor types that are suited for measuring volume flow moving on a conveyor may be used as well.

Further, a crushing plant comprises an operator control centre 109 which is typically a bearable or fixed control panel with display and user interface for controlling the crushing process. The control centre further includes a control unit 110 to implement the method according to the invention in a crushing plant. The control unit receives information such as measurement data, for instance, from sensors 111 to 115 and 136 to 138. In addition, it may collect information from the crushers about their rotation speed or power consumption and from the conveyors and the feeder about their power consumption or pressures of the hydraulic system and through that about the transfer speed and quantity of the material.

The arrangement presented in FIG. 1 is so-called three-phase crushing process. The first phase is formed by the feeder 101 and preliminary crusher 102, the second phase by the intermediate crusher 103 and conveyor 105 and the third phase is formed by the after-crusher 106 and discharge conveyor 107. The operator works with a digger 120 or a similar material transfer device such as a loading shovel and transfers material to be crushed from a heap 212 to a feeder 101.

Figure 2:
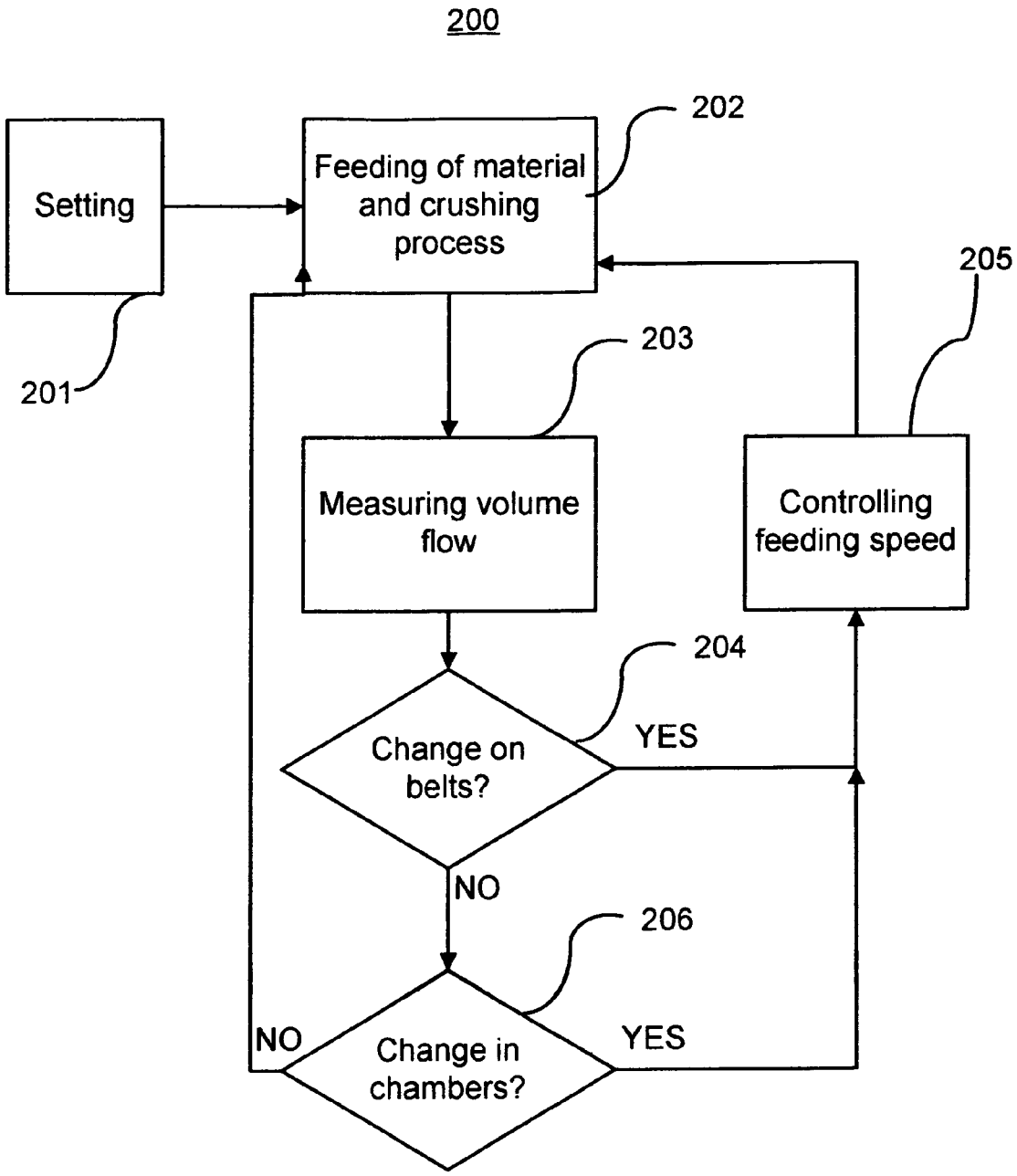
FIG. 2 presents a description of the method according to the invention as a flow chart

In FIG. 2, there is presented a method according to the invention the phases of which may preferably be implemented as a computer program code of a computer program product. The method is illustrated implemented in an environment of a two-phase crushing process, i.e. the crushing process comprises two separate crushers. The method according to the invention may be applied to multi-phase crushing processes as presented with reference to FIG. 1, 3 or 4.

In the phase 201, initial values of the system are set which happens by feeding the values through a user interface to the operator control centre 109. The operator does the setting of initial values, such as setting values of crushers, according to the properties and particle size and size distribution of material to be crushed. Further, the operator defines a maximum speed of the feeder i.e. how many moving impulses per time unit the feeder performs to the material to be crushed. A lower limit frequency may be for instance 25 Hz depending on the feeder or the properties of the feeder. An upper limit may be defined case-specifically during the process depending on the properties of the feeder and/or for instance the setting of the feeder, the variety to be made or the quality of the feed. In other words, the material flow by the controlled capacity of the feeder is arranged to fit the other process and especially to fit the capacity of the after-crushers.

The control of the surface height of the chamber of the preliminary crusher is preferably implemented by an on/off principle like an ultrasound sensor that is located to an appropriate level aside a throat funnel. The operator sets the control parameters of the preliminary crusher.

Measuring of material flow of an elevating conveyor may be implemented, for instance, by an analogical (4 to 20 mA/0 to 10 V) ultrasound sensor. Other sensors suitable for measuring the material flow may be used as well. From the user interface of the control centre, the operator sets the desired control limits which may for instance be a variable depending on the speed of the conveyor and the height of the material mat being conveyed. The control limit may be expressed for instance in cubic meters per second or in another suitable unit.

In the phase 202, a crushing process is started when material to be crushed is brought to the feeder for example with a digger, a loading shovel or in some other way. The control centre 109 and 110 may be arranged to receive information (not shown in picture) of the power consumptions, rolling speeds, hydraulic system pressures or other corresponding information of the devices 101 to 105 that may be used in controlling the crushing process.

In the phase 203, during the crushing process the material flow transferred by the conveyor 103 (115) is preferably measured continuously in the crushing process. The measuring may happen from time to time at pre-determined or incidental intervals as well.

In the phase 204, it is surveyed if in the volume flow of material travelling on a belt of a certain or each conveyor there is a change to greater (correspondingly to smaller) when compared to pre-determined limit values. If there is a change in the amount of the volume flow, in the phase 205 the speed of the feeder 101 is adjusted to smaller (correspondingly greater) to be able to stay within the range of the pre-determined limit values. Alternatively the feeder 101 may be completely brought to a halt for a pre-determined period of time or slowed down to a speed where the feeder does not have a feeding property. The capacity of the feeder 101 is primarily controlled with measuring the material flow of the conveyor 103, 133 and/or 105, 134 and otherwise with measuring the volume of material being crushed in the crushers 102 to 105. This control is aimed at controlling the material flow to be guided to the after-crusher and through that enabling a workable surface height control of the after-crusher with information of material amount being so-called in cycle and with anticipating increase and drop of the surface height of the after-crusher. The amount of material on the elevating conveyor 103, 105, 107, 133 to 135, feeding to the after-crusher is aimed to be kept at a right level by controlling the speed of the feeder 101 when required.

Alternatively or additionally to the aforementioned, the speed of the elevating conveyor 103, 105, 107, 133 to 135 may be changed to greater or smaller depending on the desired end result either by increasing or decreasing the material flow volume being conveyed per time unit. Controlling the speed of the elevating conveyor together with the control of the feeder speed already improves the control.

In the phase 206, the surface height of the crushing chamber of the preliminary crusher 102 is studied. When the surface remains up for a predetermined time, the feeder is slowed down and after a set time the feeder is stopped. After the surface has gone down, after a set time the feeder is automatically started. The observing of the surface height is aimed to prevent the preliminary crusher from over-flowing and on the other hand to prevent it from idling, pursuing the throat being full.

Correspondingly, the surface height of the crushing chamber of the intermediate crusher 104 is studied. When the surface remains up for a predetermined time, the feeder 101 and/or conveyor 103 are slowed down and after a set time the feeder and/or conveyor are stopped. After the surface has gone down, after a set time the feeder and/or conveyor are automatically started. The observing of the surface height is aimed to prevent the intermediate crusher from over-flowing and on the other hand to prevent it from idling like in the case of the preliminary crusher.

The surface height of the crushing chamber of the second after-crusher 106 may be measured as well. When the surface remains up for a pre-determined time, the feeder 101 and/or conveyor 103 and/or conveyor 105 are slowed down and after a set time the feeder and/or conveyor 103 and/or conveyor 105 are stopped. After the surface has gone down, after a set time the feeder and/or the conveyors are automatically started by the control unit 109, 110. The observing of the surface height is aimed to prevent the after-crusher from over-flowing and on the other hand to prevent it from idling.

In the phase 205, the control unit 109, 110 controls the feeding speed of the material fed by the feeder 101 in correspondence with the phases 204 and 206 on the basis of the information measured by sensors 111 to 115. Additionally or alternatively, the control unit 109, 110 may control the speeds of the conveyors 103 and/or 105, 133 to 135 on the basis of the measurement information.

Figure 3:
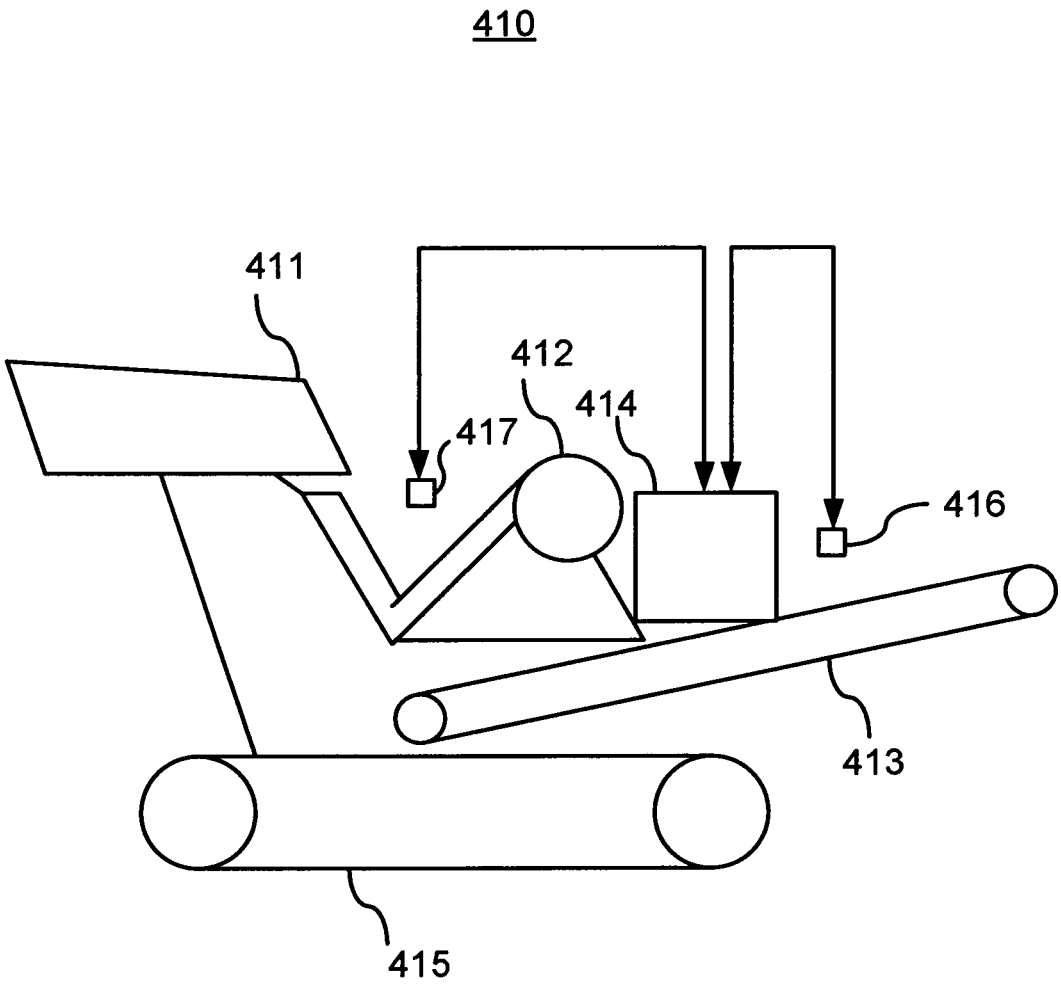
FIG. 3 presents a mobile crushing plant

In FIG. 3, there is presented a mobile track-mounted crushing plant 410 which comprises a feeder 411, a preliminary crusher 412 such as a jaw crusher, a conveyor 413, a control unit 414, a track chassis 415, a conveyor volume sensor 416 and a crushing chamber volume sensor 417 of a crusher. A mobile crushing plant may be moveable also by other means such as wheels or legs.

Figure 4:
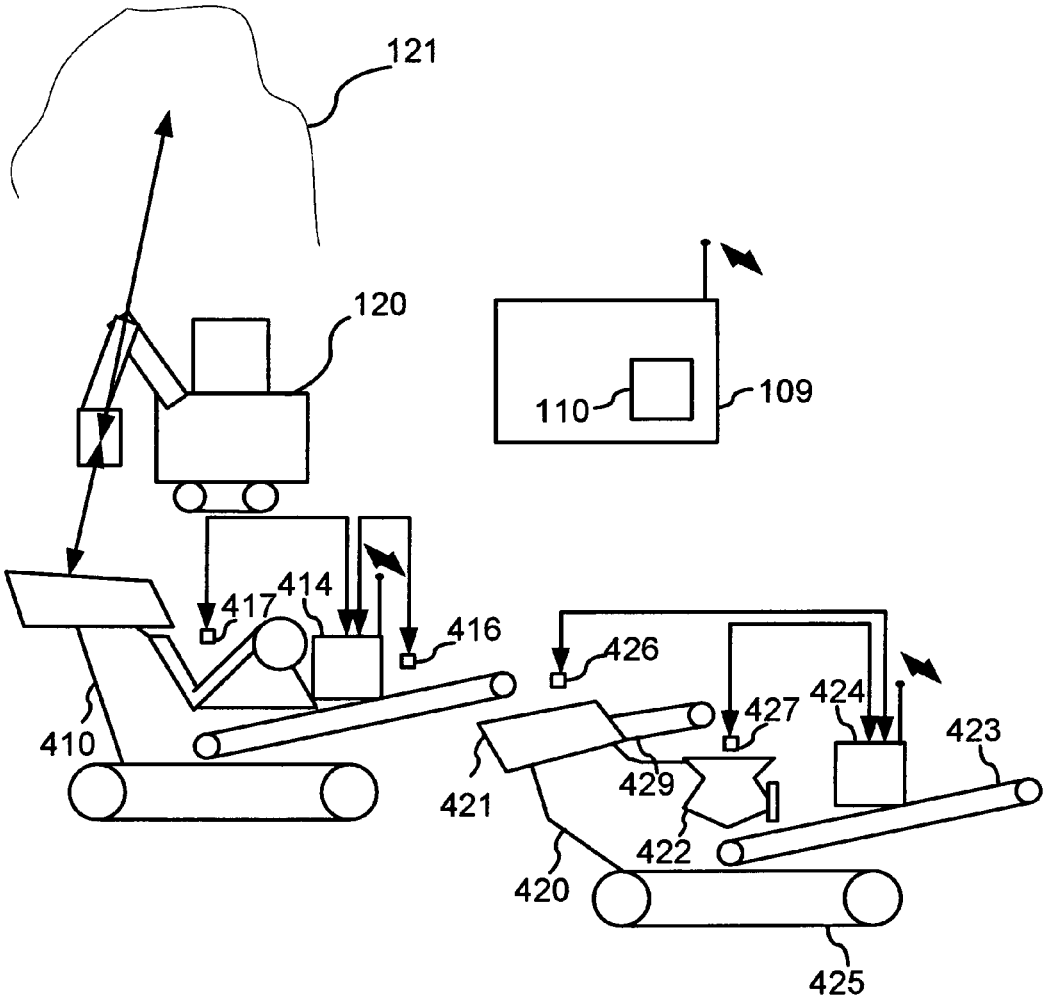
FIG. 4 presents a system created of crushing plants

In FIG. 4, there is presented a system consisting of several mobile crushing plants which system comprises a first crushing unit 410, a second crushing unit 420 and an operator working centre 109. The earlier described method according to the invention may be applied to this system.

The first crushing plant was described more detailed earlier in FIG. 3. The second crushing plant 420 comprises a feeder 421, which preferably also comprises a conveyor, an after-crusher 422 such as a cone or gyratory crusher, a discharge conveyor 423, a control unit 424, a track chassis 425, a crushing chamber volume sensor 427 of a crusher, a volume sensor 427 and a volume sensor 426 of a feeder 421, 429.

Further, the system comprises an operator control centre 109 which has a wireless communication connection to mobile crushing plants 410 and 420.

During the crushing process, the material to be crushed is fed to the feeder 411 of the first crushing plant 410 by the operator 120 from where it is further fed to the preliminary crusher 412 which in the case of this illustrated application is a jaw crusher. From the jaw crusher the pre-crushed stone material is transferred through the conveyor 413 further to the feeder 421 of the second crushing plant 420, which feeder may act as a kind of an intermediate storage before the after-crusher 422. The volume sensor 416 of the first crushing plant 410 and the volume sensor 426 of the second crushing plant measure the amount and preferably the volume of material arriving to the after-crusher 422.

Both the crushing plants are in a communication connection to the operator control centre via a control unit 414, 424 which control units are arranged to collect measurement information about parameters related to crushing and to further provide them to the control centre 109. The information measured by the sensors 416 and 426 and alternatively additionally by the sensors 417 and 426 is provided to the control centre 109 via a preferably wireless communication connection, where it is dealt with a way of the method according to the invention in the control unit 110 of the control centre as a computer program product, through which the control information of the feeder 411, 421, 429 is formed. Said information is sent further via the communication connection to the control unit 414 of the first crushing plant 410 and from there further to the control system of the feeder 411. Correspondingly the said information is sent further via the communication connection to the control unit 424 of the second crushing plant 420 and from there further to the control system of the feeder 421, 429. The location of the control centre 109 is in a preferred embodiment of the invention in the proximity of the operator 120 for instance in the cabin of the digger as a wireless graphic user interface display.

An embodiment according to the invention is especially suitable for controlling the processing of mineral material. The mineral material illustrated in this connection may be ore, mined stone or gravel, different kinds of recyclable construction waste such as concrete, tiles or asphalt.

It is not intended to limit the invention to the above, by way of example illustrated embodiments, but the invention is intended to be applied broadly within the inventive idea defined by the appended claims.

The invention claimed is:

1. A method for controlling a crushing process of mineral material in a processing device which comprises a feeder for feeding material to be crushed, at least two crushers comprising a first crusher for crushing material fed by a feeder, and at least one following phase crusher for crushing material crushed in a previous phase and at least one conveyor for conveying crushed material from the previous phase crusher to the following phase crusher, wherein the material to be crushed is fed to the first phase crusher, the volume flow of material is measured in one or more locations between two or more crushing phases by measurement means and feeding speed of the feeder or the speed of the elevating conveyor of the material to be crushed for the said following phase crusher is controlled greater or smaller by control means based on said measurement of the volume flow.

2. The method according to claim 1, further comprising indicating a momentary change in the volume of the material residing in the crushing chamber of a crusher.

3. The method according to claim 2, further comprising controlling the feeding of the first crusher responsive to an indicated momentary change in volume.

4. The method according to claim 3, further comprising indicating a momentary change in the volume of the material being conveyed on a conveyor.

5. The method according to claim 4, wherein said measuring means controls the feed of the first crusher from the conveyor on the basis of the volume flow to be measured.

6. The method according to claim 4, wherein said measuring means controls the feed of the second crusher from the conveyor on the basis of the volume flow to be measured.

7. The method according to claim 2, further comprising controlling feeding of the second crusher responsive to an indicated change in volume.

8. The method according to claim 7, further comprising indicating a momentary change in the volume of the material being conveyed on a conveyor.

9. The method according to claim 1, further comprising indicating a momentary change in the volume of the material being conveyed on a conveyor.

10. A crushing plant for crushing material wherein the crushing plant comprises a feeder for feeding material to be crushed to the crusher, a first phase crusher for crushing fed material, at least one additional crusher for crushing material crushed in the previous phase and at least one conveyor for conveying crushed material from the first phase crusher, wherein the crushing plant comprises measuring means in one or more locations between two or more crushing phases for measuring the volume flow of crushed material and control means for controlling a feeding speed of the feeder or the speed of the elevating conveyor of the material to be crushed for a following phase crusher as a response to the change in the volume flow of material crushed in the previous phases.

11. The crushing plant according to claim 10, wherein the crushing plant comprises measuring means for measuring the volume of the material being in the crushing chamber of a crusher.

12. The crushing plant according to claim 11, wherein said measuring means is arranged to control the feed of the first crusher from the conveyor on the basis of the volume flow to be measured.

13. The crushing plant according to claim 11, wherein said measuring means is arranged to control the feed of the second crusher from the conveyor on the basis of the volume flow to be measured.

14. The crushing plant according to claim 10, wherein the crushing plant comprises measuring means for measuring the volume of the material conveyed on a conveyor.

15. A system for controlling crushing process, wherein the system comprises a first phase crushing plant which further comprises a first phase feeder for feeding material, a first phase crusher for crushing material being fed, a conveyor for conveying crushed material to at least one following phase crushing plant, and which system comprises at least one following phase crushing plant comprising at least one additional crusher, which further comprises a feeder of the said following phase for feeding material crushed in the previous phase to a following phase crusher and the crusher of the said following phase for crushing material crushed in the previous phase, wherein the system comprises measuring means in one or more locations between two or more crushing phases for measuring the volume flow of crushed material and control means for controlling the feeding speed of the feeder or the speed of the elevating conveyor of the material to be crushed for the said following phase crusher as a response to the change in the volume flow of material crushed in the previous phases.

16. A crushing plant comprising a plurality of crushers with a control system including a computer program product in combination with a control unit controlling a crushing process in a crushing arrangement, which crushing arrangement comprises a feeder for feeding material to be crushed, the plurality of crushers comprising a first phase crusher for crushing material coming from the feeder, at least one conveyer for conveying the crushed material from the first phase crusher to a following phase crusher, wherein the computer program product comprises computer program means for controlling the control unit to cause measuring of the volume flow of the material in one or more locations between two or more crushing phases and computer program means for controlling the control unit to cause controlling the feeding speed of the feeder or the speed of the elevating conveyor of the material to be crushed for the said following phase crusher as a response to a change in the volume flow of material crushed in the previous phases.

* * * * *